US005840475A

United States Patent [19]

Levy et al.

[11] Patent Number: 5,840,475

[45] Date of Patent: Nov. 24, 1998

[54] PHOTOTHERMOGRAPHIC ELEMENT FOR PROVIDING A VIEWABLE RETAINED IMAGE

[75] Inventors: David H. Levy, Rochester; Lyn M. Eshelman, Penfield; Mark E. Irving, Rochester; Debra L. Hartsell, Webster, all of N.Y.

[73] Assignee: Eastman Kodak Company, Rochester, N.Y.

[21] Appl. No.: 740,110

[22] Filed: Oct. 28, 1996

[51] Int. Cl.[6] ..... G03C 1/498

[52] U.S. Cl. ..... 430/619; 430/567

[58] Field of Search ..... 430/567, 619, 430/617, 535, 531

[56] References Cited

U.S. PATENT DOCUMENTS

| | | | |
|---|---|---|---|
| 4,435,499 | 3/1984 | Reeves | 430/350 |
| 4,439,520 | 3/1984 | Kofron et al. | 430/434 |
| 4,504,568 | 3/1985 | Clark et al. | 430/203 |
| 5,264,337 | 11/1993 | Maskasky | 430/567 |
| 5,275,930 | 1/1994 | Maskasky | 430/567 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,356,764 | 10/1994 | Szajewski et al. | 430/567 |
| 5,395,746 | 3/1995 | Brust et al. | 430/567 |
| 5,468,587 | 11/1995 | Bailey et al. | 430/203 |

FOREIGN PATENT DOCUMENTS

| | | |
|---|---|---|
| 0 654 703 A1 | 5/1995 | European Pat. Off. . |

OTHER PUBLICATIONS

Research Disclosure, vol. 170, Jun. 1978, Item 17029.
Research Disclosure, vol. 299, Mar. 1989, Item 29963.

*Primary Examiner*—Thorl Chea
*Attorney, Agent, or Firm*—Carl O. Thomas

[57] ABSTRACT

An element is disclosed containing a photothermographic layer capable of providing a retained viewable image when imagewise exposed and heated. The Layer contains a high chloride {100} tabular grains.

9 Claims, No Drawings

PHOTOTHERMOGRAPHIC ELEMENT FOR PROVIDING A VIEWABLE RETAINED IMAGE

FIELD OF THE INVENTION

The invention relates to silver halide photography. More particularly, the invention relates to silver halide photographic elements that are thermally processed.

DEFINITION OF TERMS

An element or layer is "photothermographic" when it is capable of capturing an image by exposure to light and transforming the image into a viewable form when the element or layer is heated.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "high bromide" or "high chloride" in referring to grains and emulsions indicates that bromide or chloride, respectively, are present in concentrations of greater than 70 mole percent, based on total silver.

In referring to grains and emulsions containing two or more halides, the halides are named in order of ascending concentrations.

The term "{100} tabular" is employed in referring to tabular grains and tabular grain emulsions in which the tabular grains have {100} major faces.

The term "retained image" refers to a viewable image formed in a photosensitive silver halide emulsion layer.

The term "image discrimination" refers to the difference between the maximum density (Dmax) and the minimum density (Dmin) of an imagewise exposed and thermally processed photothermographic element.

*Research Disclosure* is published by Kenneth Mason Publications, Ltd., Dudley House, 12 North St., Emsworth, Hampshire P010 7DQ, England.

BACKGROUND

The extensive use of silver halide photography is attributable to its high levels of sensitivity, which is a function of an internal amplification mechanism. Silver halide emulsion layers capture photons on imagewise exposure to form an invisible latent image. Each latent image site within a grain is made up of a few atoms of silver produced by the reduction of silver ions by conduction band electrons generated by photon capture on imagewise exposure.

The most common approach to amplifying the invisible latent image into a viewable image, hereinafter referred to as main-stream photography, is to bring an aqueous developer into contact with the grains so that the latent image sites can catalyze the selective reduction of the grains on which they are located to silver while grains free of latent image sites remain relatively unaffected (i.e., undeveloped). Either developed silver or an imagewise distribution of dye produced during development can provide the viewable image.

Undeveloped grains are subsequently removed using an aqueous fixing solution. In dye image systems a bleach solution is also typically employed to remove developed silver. Often the fixing and bleaching steps are combined using a bleach-fix bath. The final steps of processing are washing with yet another aqueous solution followed by drying.

The use of aqueous processing solutions in main-stream photography to obtain a viewable image is a significant disadvantage and to many users a major disadvantage. Consequently, significant effort has been directed toward obtaining viewable images without employing aqueous processing solutions.

Photothermographic systems have attracted users from among those finding the aqueous processing of main-stream photography ranging from disadvantageous to burdensome. Photothermographic systems employ amplification techniques analogous to those of main-stream photography while eliminating aqueous processing solutions. In photothermographic systems photosensitive silver halide grains are employed to form a latent image. Upon heating in the presence of an incorporated developing agent the grains at the latent image sites are reduced to silver which catalyzes an oxidation-reduction reaction that generates a viewable image.

Although photon capture during imagewise exposure in both main-stream photography and photothermography are essentially similar and some of the same broad categories of photosensitive silver halide emulsions have been suggested for use in both systems, the major differences in the procedures for moving from a latent image to a viewable image produce imaging characteristics that are widely divergent in the two systems. Thus, it is not surprising that actual photosensitive silver halide emulsion selections for each system are usually quite different.

For example, Kofron et al U.S. Pat. No. 4,439,520, filed Nov. 12, 1981, initiated the on-going conversion of main-stream photography from photosensitive non-tabular grain silver halide emulsions to tabular grain emulsions. Kofron et al is directed to chemically and spectrally sensitized emulsions in which at least 50 percent of the total grain projected area is accounted for by tabular grains having a thickness of less than 0.3 $\mu$m, an ECD of at least 0.6 $\mu$m, and an average aspect ratio of greater than 8. Kofron et al makes clear that increased ECD'S, preferably at least 1.0 $\mu$m, and higher average aspect ratios enhance performance characteristics.

Reeves U.S. Pat. No. 4,435,499, which was the first to teach the use of tabular grain emulsions in photothermographic elements, identified a clear preference for tabular grain emulsions in which tabular grains account for at least 70 percent of total grain projected area, have an average ECD in the range of from 0.30 to 0.45 $\mu$m, and have an average aspect ratio of from 5 to 15. Notice that the maximum preferred average aspect ratio of 15 taught by Reeves is well below the minimum optimum average aspect ratio of 20 taught by Kofron et al letter. Also notice that the preferred average ECD range of Reeves is below the minimum 0.6 $\mu$m value taught by Kofron et al. Thus, the preferred emulsion selections of Kofron et al and Reeves for main-stream photography and photothermography, respectively, are mutually exclusive.

The divergence between the practical imaging demands of main-stream photography and photothermography is still more apparent when it is considered that, whereas main-stream photography has largely followed the teachings of Kofron et al in converting to tabular grain emulsions, photothermographic elements are still constructed almost exclusively using non-tabular grain emulsions.

The following patents relating to photothermography illustrate that tabular grain emulsions have from time-to-time been included among possible alternative silver halide emulsions:

Frank et al EPO 0 654 703 A1 (note page 7, line 39);

Clark et al U.S. Pat. No. 4,504,568 (note column 4, line 51); and

Bailey et al U.S. Pat. No. 5,468,587 (note column 15, lines 46–58). The fact that none of the Examples in Frank et al, Clark et al and Bailey et al employ a tabular grain emulsion provides clear evidence of the established preference for non-tabular grain emulsions in photothermographic systems.

Frank et al, Clark et al, and Bailey et al are all directed to dye image transfer systems, which in itself may account for their willingness to consider tabular grain emulsions as a possible alternative. Whereas main-stream photography fixes out undeveloped silver halide grains to impart image stability (thereby increasing image discrimination, Dmax-Dmin) and to reduce light scatter on viewing, there is no convenient mechanism for removing undeveloped silver halide grains from photothermographic elements. Accordingly, there is a clear trend in photothermography toward image transfer systems, since they allow undeveloped silver halide grains to be hidden from view. Image transfer in itself degrades image sharpness, thereby limiting imaging uses to those that do not require significant magnification. Image transfer also increases the number of layers that must be constructed. Thus, R-1, R-2 and R-3 escape some of the major disadvantages of retained image photothermographic systems only by incurring the known limitations of image transfer systems.

Broad summaries of photothermographic imaging systems are published in *Research Disclosure*, Vol. 170, June 1978, Item 17029, and Vol. 299, March 1989, Item 29963.

High chloride {100} tabular grain emulsions and their use in main-stream photographic systems are illustrated by Maskasky U.S. Pat. Nos. 5,264,337, 5,292,632 and 5,275,930, House et al U.S. Pat. No. 5,320,938, Brust et al U.S. Pat. No. 5,314,798, Szajewski et al U.S. Pat. No. 5,356,764, and Budz et al U.S. Pat. No. 5,395,746.

SUMMARY OF THE INVENTION

In one aspect this invention is directed to an element comprised of a support and, coated on the support, a photothermographic layer capable of providing a retained viewable image when imagewise exposed and heated, the layer being comprised of photosensitive silver halide grains including tabular grains having {100} major faces, containing greater than 70 mole percent chloride, based on silver, accounting for greater than 50 percent of total silver halide grain projected area, and exhibiting an average thickness of less than 0.3 $\mu$m.

It has been discovered quite unexpectedly that in photothermographic layers high chloride {100} tabular grains improve retained silver image discrimination as compared to high bromide tabular grains or high chloride {111} tabular grains.

Additionally, the high chloride tabular grains produce retained images that exhibit reduced light scattering as compared to high bromide tabular grain emulsions.

A more detailed description of these and other advantages is provided in the descriptions of preferred embodiments and Examples that follow.

DESCRIPTION OF PREFERRED EMBODIMENTS

In the simplest possible form a photothermographic element satisfying the requirements of the invention can take the following form:

| |
|---|
| Photothermographic Layer |
| Support |
| Element I |

The support can take the form of any conventional photothermographic element support, such as any of those disclosed by *Research Disclosure* Item 17029, cited above, XVII. Supports; *Research Disclosure*, 29963, cited above, XX. Supports; and, here incorporated by reference, Frank et al, Clark et al and Bailey et al, cited above, and Hanzalik et al U.S. Pat. No. 5,415,993.

Suitable supports can also be selected from among conventional photographic and radiographic element supports that are capable of withstanding thermal processing temperatures of from 80° to 250° C., preferably 120° to 200° C., for a time period ranging from 1 second to 2 minutes, usually less than 30 seconds. Conventional photographic and radiographic element supports are illustrated by *Research Disclosure*, Vol. 184, August 1979, Item 18431, XII. Film Supports, and Vol. 389, September 1996, Item 38957, XV. Supports. Particularly preferred supports are comprised of poly(ethylene terephthalate) and poly(ethylene naphthalate) films.

The photothermographic layer can be formed by modifying any conventional photothermographic layer that employs photosensitive silver halide grains in the formation of a retained viewable image. The sole required modification is the substitution of photosensitive silver halide grains including tabular grains (a) having {100} major faces, (b) containing greater than 70 mole percent chloride, based on silver, (c) accounting for greater than 50 percent of total silver halide grain projected area, and (d) exhibiting an average thickness of less than 0.3 $\mu$m.

Photosensitive silver halide grains satisfying these requirements are disclosed by the following patents, the disclosures of which are here incorporated by reference: Maskasky U.S. Pat. Nos. 5,264,337, 5,292,632, 5,275,930 and 5,399,477; House et al U.S. Pat. No. 5,320,938; Brust et al U.S. Pat. No. 5,314,798; Szajewski et al U.S. Pat. No. 5,356,764; and Chang et al U.S. Pat. No. 5,413,490.

The {100} tabular grains contain greater than 70 (preferably at least 90) mole percent chloride, based on silver forming the tabular grains. The halide content of the tabular grains can consist essentially of chloride ion. Alternatively, the tabular grains can consist essentially of silver bromochloride containing less than 30 (preferably less than 20 and optimally less than 10) mole percent bromide, based on silver forming the tabular grains. Silver iodochloride and silver iodobromochloride grains are also contemplated. It is well understood in the art that low bromide and/or iodide concentrations at grain surfaces can significantly improve the properties of the grains for photographic purposes such as spectral sensitization. Bromide and/or iodide added for the purpose of improving sensitization can usefully be precipitated onto the surface of a previously formed tabular grain population—e.g., a silver chloride tabular grain population. Significant photographic advantages can be realized with bromide or iodide concentrations as low as 0.1 mole percent, based on total silver, with minimum concentrations preferably being at least 0.5 mole percent. Iodide concentration in the tabular grains are preferably less than 5 (optimally less than 3) mole percent, based on silver forming the tabular grains.

To realize the advantages of tabular grain shape it is contemplated that the high chloride {100} tabular grain population will be relatively thin. The tabular grain population has a mean thickness of less than 0.3 μm, and preferably less than 0.2 μm. It is considered feasible to obtain mean thicknesses of less than 0.07 μm—that is, in the thickness range of ultrathin tabular grain emulsions.

It is preferred that the tabular grain population satisfy at least the first and most preferably both of the following relationships:

(I) Average aspect ratio $ECD/t > 5$ and (II) Average tabularity $ECD/t^2 > 25$ where ECD is the effective circular diameter of the tabular grains in micrometers (μm) and t is the thickness of the tabular grains in μm. In arriving at the average aspect ratio or average tabularity for a tabular grain population it is contemplated to average separately the ECD's and the thicknesses of the tabular grain population and then to obtain the quotient required by relationships I and II.

Average aspect ratios of the tabular grain population are limited only by the maximum ECD that can be tolerated by the photographic application contemplated. Acceptable imaging quality (granularity) for applications in which images are not enlarged can be realized with tabular grain mean ECD's ranging up to 10 μm. Mean tabular grain ECD's are typically less than 5 μm. Average aspect ratios ranging up to 50 can be readily realized, and higher average aspect ratios of up to 100 are believed to be achievable with optimized precipitations. It is specifically preferred that the tabular grain populations exhibit a high average aspect ratio—that is, greater than 8 and optimally at least 20.

The high chloride {100} tabular grains preferably exhibit high average tabularities—that is, greater than 25. Within the parameters of ECD, t and aspect ratio set forth above it is possible to provide tabular grain populations with extremely high tabularities ranging up to 1000. Typically the average tabularities are in the range of from >25 to 500, with tabularities of from 50 to 200 being most common.

High chloride {100} tabular grains account for at least 50 percent of total grain projected area. It is, of course, preferred to maximize the percentage of total grain projected area accounted for by the high chloride {100} tabular grains as the grains are initially precipitated. Thus, high chloride {100} tabular grain projected areas of greater than 70 percent and greater than 90 percent are progressively favored.

It is specifically contemplated to employ high chloride {100} tabular grains that contain one or more dopants. Illustrations of useful dopants are provided by the patents cited and incorporated by reference above to show conventional high chloride {100} tabular grain emulsions. Dopants for the high chloride {100} tabular grains are also illustrated by *Research Disclosure*, Item 38957, cited above, Section I. Emulsion grains and their preparation, D. Grain modifying conditions and adjustments, paragraphs (3) to (5).

The entire photosensitive silver halide grain population of the photothermographic layer can be formed during the precipitation of the high chloride {100} tabular grains. In this instance the composition of the entire grain population is similar, usually identical, with the grains other than {100} tabular grains being principally non-tabular grains with {100} crystal faces.

It is recognized that minor amounts of other silver halide grains, either tabular or non-tabular, can be blended with the silver halide emulsion containing the high chloride {100} tabular grains. Examples of silver halide grain blending to achieve specific photographic effects are illustrated by *Research Disclosure*, Item 38957, cited above, Section I. Emulsion grains and their preparation, E. Blends, layers and performance categories, particularly paragraph (6).

The photosensitive silver halide grains are preferably washed to remove soluble salts produced in their formation. Emulsion washing procedures are illustrated by *Research Disclosure*, Item 38957, cited above, III. Emulsion washing. The peptizers associated with the grain surfaces as precipitated remain with the grains are carried with the grains into photothermographic layer.

The photosensitive silver halide grains can be chemically and/or spectrally sensitized by any convenient conventional technique. Illustrations of useful chemical and spectral sensitizations are provided by the patents cited and incorporated by reference above to show conventional high chloride {100} tabular grain emulsions. In addition, conventional techniques for sensitizing photosensitive silver halide grains are illustrated by *Research Disclosure*, Item 38957, cited above, IV. Chemical sensitization and V. Spectral sensitization and desensitization, A. Sensitizing dyes.

In one particularly contemplated form of the invention, referred to as a Type A formulation, the photothermographic layer is comprised of (a) photosensitive silver halide grains, including high chloride {100} tabular grains, as described above;

(b) a light-insensitive, reducible silver source;

(c) a reducing agent for the light-insensitive reducible silver source; and (d) a binder.

The photosensitive silver halide grains can be employed in any conventional level within the photothermographic layer. As disclosed by Hanzalik et al U.S. Pat. No. 5,415,993, the silver halide grains can be present in a concentration as low as 0.01 percent by weight, based on the total weight of the photothermographic layer. It is preferred that the silver halide grains be present in a concentration of at least 5 and, optimally, at least 10 percent by weight, based on the total weight of the photothermographic layer. Silver halide grain concentrations of up to 35 percent by weight or higher, based on the total weight of the photothermographic layer are contemplated, but, for most imaging applications, it is preferred that the silver halide grains be present in concentrations of less than 25 (optimally less than 10) percent by weight, based on the total weight of the photothermographic layer.

The light-insensitive, reducible silver source can be any material that contains a source of reducible silver ions. Silver salts of organic acids, particularly silver salts of long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention. The source of reducible silver material generally constitutes from 20 to 70 percent by weight of the photothermographic layer. It is preferably present at a level of 30 to 55 percent by weight of the photothermographic layer.

The organic silver salt is a silver salt which is comparatively stable to light, but forms a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, thiazole, imidazoline, imidazole, diazole, pyridine and triazine. Preferred examples of these heterocyclic compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl) -4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzothiazole and a derivative thereof as described in Japanese patent publications 30270/69 and 18146/70, for example a silver salt of benzotriazole such as silver salt of methylbenzotriazole, etc., a silver salt of a halogen substituted benzotriazole, such as a silver salt of 5-chlorobenzotriazole, etc., a silver salt of 1,2,4-triazole, of lH-tetrazole as described in U.S. Pat. No. 4,220,709, a silver salt of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in *Research Disclosure* October 1983 (23419) and U.S. Pat. No. 3,985,565.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

The reducing agent for the organic silver salt may be any material, preferably organic material, that can reduce silver ion to metallic silver. Conventional photographic developers such as 3-pyrazolidinones, hydroquinones, and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine,piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; 3-pyrazolidones; and certain indane-1,3-diones.

Any conventional photothermographic layer binder can be employed. Conventional binders include hydrophilic colloid binders (e.g., hardened gelatin and gelatin derivatives), such as those disclosed in *Research Disclosure*, Item 38957, cited above, II. Vehicles, vehicle extenders, vehicle-like addenda and vehicle related addenda. The hydrophilic colloids disclosed therein principally as peptizers are also recognized to be useful binders and are employed in this invention employed principally as binders. Also contemplated for use as binders are synthetic resins such as polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic binders are poly(vinyl butyral), butylethyl cellulose, methacrylate copolymers, maleic anhydride ester copolymers, polystyrene, and butadienestyrene copolymers.

It is specifically contemplated to employ organo-gel binders of the type disclosed by Hanzalik et al PCT WO 94/25900 and U.S. Pat. No. 5,415,993, the disclosure of which is here incorporated by reference.

The binders are employed in any convenient concentration for dispersing the components contained therein. Typically a preferred ratio of the binder to the light-insensitive, reducible silver source ranges from 15:1 to 1:2, most typically from 8:1 to 1:1. Since the binder and the light-insensitive, reducible silver source constitute the two highest concentration components of the photothermographic layer, it is preferred that these materials be chosen for maximum compatibility with this component. For example, whereas the light-insensitive, reducible silver source is a relatively hydrophilic material, such silver salts of compounds containing mercapto or thione groups, a hydrophilic colloid binder is favored, whereas, when the light-insensitive, reducible silver source is a more hydrophobic material, such as a silver soap or half soap—e.g., silver behenate, a synthetic resin binder, such as a vinyl acetal polymer or copolymer, is preferred.

In addition to the essential components of the Type A formulation described above, it is appreciated that various optional components can additionally be present. In forming viewable silver images tone modifiers, such as those illustrated by *Research Disclosure*, Item 17029, cited above, V. Tone Modifiers, are particularly important to modifying silver particle formation during development and hence providing a more uniform and pleasing image tone.

Examples of toners include phthalimide and N-hydroxyphthalimide; cyclic imides such as succinimide, pyrazoline-5-ones and a quinazolinone 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2, 4-dimercaptopyrimidine, 3-mercapto-4,5-diphenyl-1,2,4-triazole and 2,5-dimercapto-1,3,4-thiadiazole; N-(aminomethyl)aryldicarboximides, e.g., (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylenebis (1-carbamoyl-3,5-dimethylpyrazole), 1,8-(3,6-diazaoctane)bis(isothiuronium) trifluoroacetate and 2-(tribromomethylsulfonyl benzothiazole); and merocyanine dyes such as 3-ethyl-5[(3-ethyl-2-benzothiazolinylidene)-1-methyl-ethylidene]-2-thio-2,4-o-azolidinedione; phthalazine and phthalazine derivatives; 1-(2H)-phthalazinone and 1-(2H)-phthalazinone derivatives or metal salts of these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimides, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene.

The preferred concentrations of toners are in the range of from 0.01 (most preferably 0.1) to 10 percent by weight, based on the total weight of the photothermographic layer.

Antifoggants and stabilizers for the photosensitive silver halide grains are preferably incorporated in the photothermographic layer. A variety of base generating materials, commonly referred to as activators, are conventionally employed in photothermographic layers to improve development. In order to simplify the coating compositions, activation and stabilization can be combined. Addenda in these classes are illustrated by *Research Disclosure*, Item 17029, cited above, IV. Activators/Activator Stabilizers/Stabilizers, A. Activators and Activator Precursors, B. Stabilizers and Stabilizer Precursors, and C. Activator/Stabilizers and Activator/Stabilizer Precursors, and VIII. Antifoggants/Post-processing Print-Out Stabilizers.

Specifically preferred antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Pat. No. No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Additionally, addenda contemplated to improve the physical properties of the photothermographic layer are contemplated. Such addenda are illustrated by *Research Disclosure*, Item 38957, cited above, IX. Coating physical property modifying addenda, A. Coating aids, B. Plasticizers and lubricants, C. Antistats and D. Matting Agents and by *Research Disclosure*, Item 17029, cited above, X. Coating Aids.

Upon imagewise exposure and thermal processing the Type A formulations described above produce a retained negative silver image. It has been discovered quite unexpectedly that, when high chloride {100} tabular grains satisfying the requirements described above are employed, superior image discrimination is obtained. Surprisingly, image discrimination is much larger when high chloride {100} tabular grain emulsions are employed than when high bromide tabular grain emulsions, with or without iodide, are employed. Still more surprising, high chloride {100} tabular grain emulsions produce much higher levels of image discrimination than high chloride {111} tabular grain emulsions.

It has also been observed that reduced light scattering is produced by the high chloride tabular grains than by the high bromide tabular grains.

It is additionally contemplated that the photothermographic layer can be modified by eliminating the light-insensitive, reducible silver source and increasing the coating coverage of the photosensitive silver halide grains to compensate stoichiometrically for the removal of the light-insensitive silver source. In one particularly contemplated form of this type, referred to as a Type B formulation, the photothermographic layer is comprised of (a) photosensitive silver halide grains, including high chloride {100} tabular grains, as described above;

(b) an incorporated developing agent;

(c) one or a combination of an activator, an activator-stabilizer, and a stabilizer or stabilizer precursor; and (d) a binder.

As variations of the Type A and B formulations above, hereinafter referred to as a Type A/D and B/D formulations, the developing or reducing agent can be chosen to form a dye image. For example, where the incorporated developing or reducing agent is a color developing agent, it can react with a dye-forming coupler to produce an azo dye image. Particularly useful color developing agents are the p-phenylenediamines and especially the N-N-dialkyl-p-phenylenediamines in which the alkyl groups or the aromatic nucleus can be substituted or unsubstituted. Common p-phenylenediamine color developing agents are N-N-diethyl-p-phenylenediamine monohydrochloride, 4-N,N-diethyl-2-methylphenylenediamine monohydrochloride, 4-(N-ethyl-N-2-methanesulfonylaminoethyl)-2-methylphenylenediamine sesquisulfate monohydrate, and 4-(N-ethyl-N-2-hydroxyethyl)-2-methylphenylenediamine sulfate. Other p-phenylenediamines, similar compounds, and their use include those described in Nakamura et al U.S. Pat. No. 5,427,897, Mihayashi et al U.S. Pat. No. 5,380,625, Haijima et al U.S. Pat. No. 5,328,812, Taniguchi et al U.S. Pat. No. 5,264,331, Kuse et al U.S. Pat. No. 5,202,229, Mikoshiba et al U.S. Pat. No. 5,223,380, Nakamuara et al U.S. Pat. No. 5,176,987, Yoshizawa et al U.S. Pat. No. 5,006,437, Nakamuara U.S. Pat. No. 5,102,778 and Nakagawa et al U.S. Pat. No. 5,043,254. Dye-forming couplers useful with color developing agents are illustrated by *Research Disclosure*, Item 38957, cited above, X. Dye image formers and modifiers, B. Image-dye-forming couplers.

Leuco dyes are another class of reducing agents that form a dye image upon oxidation. The leuco dye can be any colorless or slightly colored compound that can be oxidized to a colored form, when heated, preferably to a temperature of from about 80° to 250° C. for a duration of from 0.5 to 300 seconds. Any leuco dye capable of being oxidized by silver ion to form a visible image can be used.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes". These dyes are prepared by oxidative coupling of a p-phenylenediamine with a phenolic or anilinic compound. Leuco dyes of this class are described in U.S. Pat. No. 4,594,307.

A third class of dyes useful in this invention are "aldazine" and "ketazine" dyes. Dyes of this type or described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type ore described in Japanese Patent 52-89131 and U.S. Pat. Nos. 2,784,186; 4,439,280; 4,563,415; 4,570,171; 4,622,395 and 4,647,525, all of which are incorporated hereby by reference.

Other illustrations of color materials are set out in *Research Disclosure*, Item 17029, cited above, XV. Color materials. Various conventional components that are employed in combination with dye image formers can additionally be present in the photothermographic layer. Such components include those set out in *Research Disclosure*, Item 38957, cited above, X. Dye image modifiers and addenda, C. Image dye modifiers, D. Hue modifiers/stabilization, and E. Dispersing dyes and dye precursors. Dye image stabilizers, such as those set out in paragraph (3) of section D, are particularly preferred components.

The foregoing discussion has been referenced to the simplest possible construction, Element I, consisting of only a support and a single photothermographic layer. It is appreciated that in practice other layers are commonly employed in combination. For example, a protective overcoat layer is in most instances present. Such layers are illustrated by *Research Disclosure*, Item 17029, cited above, XI. Overcoat layers. It is appreciated that the physical property modifying components, such as coating aids, plasticizers and lubricants, antistats and matting agents, described above for incorporation in the photothermographic layer can be and usually are shifted in whole or in part from the photothermographic layer to an outer layer, such as an overcoat, or, in some instances, a backing layer on the opposite side of the support. The binder forming the overcoat layer preferably is chosen for compatibility with the binder of the photothermographic layer while the binder of any backing layer can be independently chosen.

The photothermographic layer can contain a filter or antihalation dye. Suitable dyes are disclosed in *Research Disclosure*, Item 17029, cited above, XIV. Filter Dyes/Antihalation Layers, and Item 38957, cited above, VIII. Absorbing and scattering materials, particularly B. Absorbing materials. When an antihalation dye is employed, it can be incorporated in the photothermographic layer, but to increase speed it is normally incorporated in a underlayer coated between the photothermographic layer and the support or in a backing layer. When an underlayer is provided, it contains a binder compatible with the photothermographic layer and usually employs the same binder. It is recognized that various of the optional addenda described above for incorporation in the photothermographic layer can be shifted in whole or in part to the underlayer.

As most commonly employed photothermographic elements provide a silver image upon imagewise exposure and processing. A single photothermographic layer usually provides this function, although multiple photothermographic layers are known. In producing a dye image of a single hue, a single photothermographic layer can still be employed.

Photothermographic elements capable of recording the natural colors of photographic subjects as negative images can be formed merely by employing the same general types of layer order arrangements employed in main-stream photography. For example, the following construction is contemplated:

| |
|---|
| Overcoat |
| Third Dye Image-Forming Layer Unit |
| Second Interlayer |
| Second Dye Image-Forming Layer Unit |
| First Interlayer |
| First Dye Image-Forming Layer Unit |
| Underlayer |
| Support |
| Backing Layer |
| Element II |

The Support, Backing Layer, Underlayer and Overcoat can be constructed as described above and require no further description. The First and Second Interlayers preferably employ a binder similar to that of the contiguous photothermographic layers and, if required by the dye image formers chosen, additionally contain an antistain agent (e.g., oxidized developing agent scavenger) to minimize color contamination by migrating reactants. Antistain agents are illustrated by *Research Disclosure*, Item 38957, cited above, X. Dye image formers and modifiers, D. Hue modifiers/stabilization, paragraph (2).

Each of the First, Second and Third Dye Image Forming Layer Units contain photosensitive silver halide grains spectrally sensitized to a different one of the blue, green and red regions of the visible spectrum. Since high chloride emulsions exhibit little native sensitivity within the visible region of the spectrum, the problem of blue light capture by layer units intended record in the minus (red and/or green) regions of the spectrum does not arise. Thus, yellow absorbers to protect minus blue recording layer units from color contamination are unnecessary, and color contamination is not a factor to consider in selecting placements of the blue, green and red photosensitive silver halide grains in the layer units. It is, in fact, preferred to locate the green sensitized silver halide grains in the third layer unit to maximize its speed and image sharpness, to locate the red sensitized silver halide grains in the second layer unit, and to locate the blue sensitized silver halide grains in the first layer unit. This accords a position preference for the green, red and blue sensitized silver halide grains that corresponds to the human eye's ability to extract information from each of these spectral regions.

EXAMPLES

The invention can be better appreciated by reference to the following specific embodiments. Except as otherwise stated the contents of the reaction vessels were vigorously stirred throughout grain precipitation.

Emulsion 1

An AgBr {111} tabular grain emulsion was prepared in the following manner:

To a well stirred reaction vessel at 35° C. were added 30 g of NaBr, 10 g of lime processed bone gelatin, and enough water to bring the final volume to 5 liters. Grain nucleation was accomplished by the simultaneous addition of 2.75M $AgNO_3$ and 2.87M NaBr, both at rates of 35 mL/min for 1.25 minutes.

The reaction vessel contents were held for 1 minute, at which time 0.42 mole of $NH_4SO_4$ was added. NaOH in the amount of 0.85 mole was then added to the kettle, followed after 1.5 minutes by the addition of 0.85 mole of $HNO_3$. The contents of the reaction vessel were stirred for 1 minute, and then 1900 g of a 7.5% by weight gelatin solution were added. The mixture was stirred for 5 minutes, at which time the 2.75M solution of $AgNO_3$ was run in at the flow rates and times listed in Table I. A 2.75M NaBr solution was used to maintain the pBr of the reaction vessel at 1.6.

TABLE I

| Growth Segment | Initial Flow mL/min | Final Flow mL/min | Segment Time minutes |
|---|---|---|---|
| I | 15 | 15 | 3 |
| II | 15 | 40 | 25 |
| III | 40 | 102 | 31 |
| IV | 100 | 100 | 1.5 |

At the conclusion of grain growth the emulsion was washed and concentrated. The resulting AgBr {111} tabular grain emulsion exhibited a mean grain ECD of 0.75 μm and a mean grain thickness of 0.12 μm. Tabular grains accounted for greater than 90 percent of total grain projected area. The emulsion was optimally sulfur and gold sensitized using aurous dithiosulfate and sodium thiosulfate and spectrally sensitized using a 6:1 molar ratio of Dye 1:Dye 2, where Dye 1 was anhydro-5-chloro-9-ethyl-5'-phenyl-3'-(3-sulfobutyl)-3-(3-sulfopropyl)oxacarbocyanine hydroxide, sodium salt and Dye 2 was anhydro-3,9-diethyl-3'-methylsulfonylcarbamoylmethyl-5-phenyloxathiocarbocyanine hydroxide.

Emulsion 2

An AgIBr {111} tabular grain emulsion was prepared in the following manner:

To a well stirred reaction vessel at 40° C. were added 4.9 g of NaBr, 15.6 g of lime processed bone gelatin, 1.17 g of a polyethylene oxide antifoamant, and enough water to bring the final volume to 7.8 liters. Grain nucleation was accomplished by the simultaneous addition of 2.3M $AgNO_3$ and 2.3M NaBr, both at rates of 84.5 mL/min for 1 minute.

NaBr in the amount of 0.15 mole was then added to the reaction vessel, followed after 1 minute by a temperature ramp to 55° C. over 9 minutes. Then 0.2 mole of $NH_4SO_4$ was added, and the pH was adjusted to 9.5 with NaOH and held for 9 minutes. Then 1300 g of a 7.5% by weight gelatin solution were added, and the mixture was held for 5 minutes, following which the pH of the reaction vessel was adjusted to 6.5 with nitric acid. Grain growth was accomplished by the addition of a 2.24 solution of $AgNO_3$ at the flow rates and times listed in Table II. A 2.3M NaBr solution was used to maintain the pBr of the reaction vessel at 1.9. During growth segment III 0.44 g of $K_4Ru(CN)_6$ was added to the reaction vessel.

TABLE II

| Growth Segment | Initial Flow mL/min | Final Flow mL/min | Segment Time minutes |
|---|---|---|---|
| I | 15 | 13 | 5 |
| II | 13 | 87 | 52 |
| III | 87 | 87 | 1 |

At the conclusion of growth segment III, a 1M solution of KI was run into the reaction vessel at 169 mL/min for 2 minutes, followed by a hold for 10 minutes. Finally, the 2.24M $AgNO_3$ solution was run into the reaction vessel at a linearly ramped flow rate of from 13 mL/min to 45 mL/min over 42.5 minutes. Once the pBr reached 2.9, it was maintained at that level by the simultaneous addition of a 2.3M NaBr solution.

At the conclusion of grain growth the emulsion was washed and concentrated. The resulting AgIBr {111} tabular grain emulsion exhibited a mean grain ECD of 0.66 μm and a mean grain thickness of 0.13 μm. Tabular grains accounted for greater than 90 percent of total grain projected area. The overall iodide concentration of the emulsion was 3.6 mole percent, based on silver. The emulsion was optimally sulfur and gold sensitized using aurous dithiosulfate and sodium thiosulfate and spectrally sensitized using a 6:1 molar ratio of Dye 1:Dye 2.

Emulsion 3

An AgIC1 {111} tabular grain emulsion was prepared in the following manner:

To a well stirred reaction vessel at 50° C. were added 9.3 g of NaCl, 80 g of lime processed bone gelatin, 3.9 L of water, and a solution containing 2.84 g of 7-azaindole with a pH of 2.5. The pH of the reaction vessel was then adjusted to 5.5. Grain nucleation was accomplished by a single-jet addition of 2M $AgNO_3$ at a rate of 8 mL/min for 0.6 minute.

Immediately following nucleation the growth stages listed in Table III were conducted by adding as a second jet 4M NaCl while maintaining the pCl of the reaction vessel at 1.5. The $AgNO_3$ solution concentrations flow rates and times for the growth stages are listed in Table III.

TABLE III

| Growth Segment | $AgNO_3$ Conc. (molar) | Initial Flow mL/min | Final Flow mL/min | Time minutes |
|---|---|---|---|---|
| I | 2 | 8 | 16 | 2.8 |
| II | 4 | 8 | 30 | 15 |
| III | 4 | 30 | 30 | 14 |

After a 1 minute hold 4M $AgNO_3$ was run into the reaction vessel at 23 mL/min for 2.4 minutes while the pCl was maintained at 1.5 using a solution that is 3.6M in NaCl and 0.4M in KI.

At the conclusion of grain growth the emulsion was washed and concentrated. The resulting AgICl {111} tabular grain emulsion exhibited a mean grain ECD of 0.86 μm and a mean grain thickness of 0.1 μm. Tabular grains accounted for greater than 90 percent of total grain projected area. The halide content of the grains was 0.70 mole percent iodide and 99.3 mole percent chloride, based on total silver. The emulsion was spectrally sensitized with Dye 1. The emulsion was optimally sulfur and gold sensitized using potassium tetrachloroaurate(III) and sodium thiosulfate.

Emulsion 4

A high chloride AgICl {100} tabular grain emulsion was prepared in the following manner:

To a well stirred reaction vessel at 35° C. were added 1.48 g of NaCl, 38.8 g of an oxidized lime processed bone gelatin, 0.28 g of KI, and enough water to bring the final volume to 4.5 liters. Grain nucleation was accomplished by the simultaneous addition of SOLN-1, 4M $AgNO_3$ that contained 0.32 g/L of $HgCl_2$, and 4M NaCl, both at rates of 21 mL/min for 0.5 minute.

Immediately following nucleation, 9.1 L of a solution containing 0.39 g/L NaCl and 0.12 g/L of KI were added to the reaction vessel. This mixture was held for 8 minutes. Grain growth was then undertaken by adding SOLN-1 at the flow rates and times listed in Table IV. The pCl of the reaction vessel was maintained at 2.2 by the simultaneous addition of 4M NaCl.

TABLE IV

| Growth Segment | Initial Flow mL/min | Final Flow mL/min | Segment Time minutes |
|---|---|---|---|
| I | 14 | 14 | 5 |
| II | 14 | 42 | 52 |

At the conclusion of growth segment II, a 4M solution of NaCl was run into the reaction vessel at 14 mL/min for 5 minutes, followed by a hold for 30 minutes. Thereafter SOLN-1 was run into the reaction vessel at 14 mL/min for 5 minutes, followed by the addition of 70 mL of a solution containing 5.25 g of KI. After a 20 minute hold, a final growth segment was performed by the 8 minute addition of 14 mL/min of SOLN-1, with the simultaneous addition of the 4M NaCl solution to maintain the pCl at 2.2.

At the conclusion of grain growth the emulsion was washed and concentrated. The resulting high chloride {100} tabular grain emulsion exhibited a mean grain ECD of 0.56 μm and a mean grain thickness of 0.09 μm. Tabular grains accounted for greater than 70 percent of total grain projected area. The halide content of the grains was 0.6 mole percent iodide and 99.4 mole percent chloride, based on total silver. The emulsion was spectrally sensitized with a 6:1 molar ratio of Dye 1:Dye 2. The emulsion was optimally sulfur and gold sensitized using potassium tetrachloroaurate(III) and sodium thiosulfate.

Photothermographic Layers

The photothermographic coating compositions were prepared using a solvent mixture containing methyl iso-butyl ketone and toluene. To incorporate the grains of each Emulsions 1 through 4 separately into coating compositions, an emulsion solvent was produced containing 6.25% benzyl alcohol and 4.69% of poly(vinyl butyral) in toluene, the percentages being weight percentages, based on total weight. An ultrasonic probe capable of delivering 50 W was placed into a stirred 44 g sample of the emulsion solvent. Ultrasonic energy was applied to the emulsion solvent while 0.015 mole of a melted sample of one of Emulsions 1 through 4 was added, followed by 9 additional minutes of sonification. This resulted in a suspension of the silver halide grains in the coating solvent.

Elements were prepared by coating a single photothermographic layer on a transparent film support. Each of the photothermographic layers contained 37.5 mg/dm$^2$ of poly (vinyl butyral) binder, 5.0 mg/dm$^2$ of silver provided by the silver halide grains, and 7.0 mg/dm$^2$ of silver provided by silver behenate, as a light insensitive source of silver. In addition these coatings contained N-(4-hydroxyphenyl) benzenesulfonamide (DEV-1) as a developing agent and succinimide (ACC-1) as a development accelerator. The concentrations of DEV-1 and ACC-1 were varied as shown below.

Each coating was exposed by a 5500° K light source through a step wedge and a Kodak Wratten™ 9 filter, which allows transmission at wavelengths longer than 460 nm, for 0.01 second, followed by thermal processing for 2 seconds at 128° C.

The performance of photothermographic coatings prepared with the AgBr {111} tabular grains of Emulsion 1 is summarized in Table V.

TABLE V

| DEV-1 mg/dm$^2$ | ACC-1 mg/dm$^2$ | $D_{min}$ | $D_{max}$ | $D_{max}$-$D_{min}$ |
|---|---|---|---|---|
| 14.3 | 3.2 | 0.21 | 0.31 | 0.10 |
| 14.3 | 4.8 | 0.50 | 1.03 | 0.53 |
| 14.3 | 6.5 | 0.46 | 0.98 | 0.52 |
| 17.0 | 3.2 | 0.31 | 0.81 | 0.50 |
| 17.0 | 4.8 | 0.32 | 0.68 | 0.36 |
| 17.0 | 6.5 | 0.64 | 1.09 | 0.55 |
| 19.6 | 3.2 | 0.54 | 1.01 | 0.47 |
| 19.6 | 4.8 | 0.56 | 1.05 | 0.49 |
| 19.6 | 6.5 | 0.46 | 1.00 | 0.54 |

The performance of photothermographic coatings prepared with the AgIBr {111} tabular grains of Emulsion 2 is summarized in Table VI.

TABLE VI

| DEV-1 mg/dm$^2$ | ACC-1 mg/dm$^2$ | $D_{min}$ | $D_{max}$ | $D_{max}$-$D_{min}$ |
|---|---|---|---|---|
| 9.6 | 3.2 | 0.46 | 0.50 | 0.04 |
| 9.6 | 4.8 | 0.47 | 0.55 | 0.08 |
| 9.6 | 6.5 | 0.58 | 0.81 | 0.23 |
| 14.5 | 3.2 | 0.60 | 0.78 | 0.18 |
| 14.5 | 4.8 | 0.71 | 1.05 | 0.36 |
| 14.5 | 6.5 | 0.81 | 1.18 | 0.37 |
| 17.2 | 3.2 | 0.81 | 1.06 | 0.25 |
| 17.2 | 4.8 | 0.76 | 1.11 | 0.35 |
| 17.2 | 6.5 | 0.79 | 1.18 | 0.39 |
| 19.9 | 3.2 | 0.95 | 1.18 | 0.23 |
| 19.9 | 4.8 | 1.00 | 1.25 | 0.25 |
| 19.9 | 6.5 | 0.89 | 1.05 | 0.16 |

The performance of coatings prepared with the high chloride {111} tabular grains of Emulsion 3 is summarized in Table VII.

TABLE VII

| DEV-1 mg/dm$^2$ | ACC-1 mg/dm$^2$ | $D_{min}$ | $D_{max}$ | $D_{max}$-$D_{min}$ |
|---|---|---|---|---|
| 14.3 | 3.2 | 0.19 | 0.52 | 0.33 |
| 14.3 | 4.8 | 0.27 | 0.64 | 0.37 |
| 14.3 | 6.5 | 0.24 | 0.60 | 0.36 |
| 17.0 | 3.2 | 0.27 | 0.50 | 0.23 |
| 17.0 | 4.8 | 0.18 | 0.38 | 0.20 |
| 17.0 | 6.5 | 0.69 | 0.77 | 0.08 |

The performance of coatings prepared with the high chloride {100} tabular grains of Emulsion 4 is summarized in Table VIII.

TABLE VIII

| DEV-1 mg/dm$^2$ | ACC-1 mg/dm$^2$ | $D_{min}$ | $D_{max}$ | $D_{max}$-$D_{min}$ |
|---|---|---|---|---|
| 9.6 | 3.2 | 0.19 | 0.70 | 0.51 |
| 9.6 | 4.8 | 0.18 | 0.83 | 0.65 |
| 9.6 | 6.5 | 0.22 | 1.02 | 0.80 |

TABLE VIII-continued

| DEV-1 mg/dm$^2$ | ACC-1 mg/dm$^2$ | $D_{min}$ | $D_{max}$ | $D_{max}$-$D_{min}$ |
|---|---|---|---|---|
| 14.5 | 3.2 | 0.19 | 0.95 | 0.76 |
| 14.5 | 4.8 | 0.21 | 0.95 | 0.72 |
| 14.5 | 6.5 | 0.21 | 0.93 | 0.79 |
| 17.2 | 3.2 | 0.21 | 1.00 | 0.81 |
| 17.2 | 4.8 | 0.21 | 1.02 | 0.77 |
| 17.2 | 6.5 | 0.21 | 0.98 | 0.79 |
| 19.9 | 3.2 | 0.23 | 0.97 | 0.74 |
| 19.9 | 4.8 | 0.25 | 1.01 | 0.76 |
| 19.9 | 6.5 | 0.22 | 0.99 | 0.77 |

From a comparison of Tables V through VIII, it is apparent that the highest levels of image discrimination ($D_{max}$–$D_{min}$) were achieved employing the high chloride {100} tabular grains provided by Emulsion 4. This establishes an unexpected advantage for these emulsions in photothermographic layers.

Image Sharpness

Photothermographic elements differing in their tabular silver halide grain composition were compared to determine the effect of this difference.

Sample 1

Onto a transparent cellulose acetate photographic film support were coated the following layers. Coating coverages are in g/m$^2$ and emulsion coating coverages are based on the weight of silver.

| | |
|---|---|
| Layer 1 (Photothermographic layer) | |
| Emulsion 2 | 0.54 |
| Dye-forming coupler C-1 | 0.86 |
| Silver 3-amino-5-benzylmercapto-1,2,4-triazole | 0.65 |
| Gelatin | 4.3 |
| S-1, t-Butylphenoxyethoxyethyl-sulfonic acid | 0.04 |
| S-2, Nonylphenoxypolyglycerol | 0.02 |
| Layer 2 (Overcoat) | |
| 2-[(4-amino-3-methylphenyl)ethylamino]-ethanol sulfate | 0.65 |
| Sodium sulfite | 0.16 |
| Gelatin | 2.7 |
| S-1 | 0.04 |
| S-2 | 0.02 |

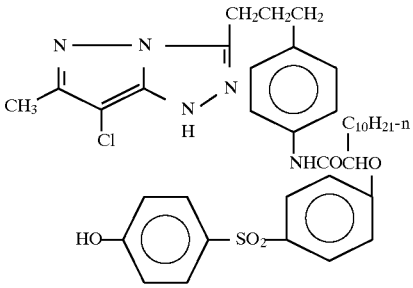

C-1

Sample 2

Sample 2 was prepared identically to Sample 1, except that Emulsion 4 was substituted for Emulsion 2.

Evaluation

Both samples were measured for specular and total transmission with a Milton Roy dyano Matchscan II ™ spectrophotometer. The collection angle for specular transmittance was eight degrees. The percent specular transmittance was calculated as follows: % specular transmittance=100× specular transmittance÷total transmittance. The results are summarized below in Table IX.

TABLE IX

| | | % Specular Transmittance | | |
|---|---|---|---|---|
| Sample | Emulsion | 450 nm | 550 nm | 650 nm |
| 1 (control) | 2 | 26 | 43 | 55 |
| 2 (example) | 4 | 42 | 61 | 68 |

It is demonstrated in Table IX that the high chloride {100} tabular grain emulsion (Emulsion 4) produced a photothermographic layer having a higher spectular transmittance than the silver iodobromide {111} tabular grain emulsion (Emulsion 2). Improved specular transmittance facilitates viewing of the retained image in the photothermographic layer.

The invention has been described in detail with particular reference to preferred embodiments thereof, but it will be understood that variations and modifications can be effected within the spirit and scope of the invention.

What is claimed is:

1. An element comprised of a support and, coated on the support, a photothermographic layer capable of providing a retained viewable image when imagewise exposed and heated, said layer being comprised of (1) photosensitive silver halide grains including tabular grains having {100} major faces, containing greater than 70 mole percent chloride, based on silver, accounting for greater than 50 percent of total silver halide grain projected area, and exhibiting an average thickness of less than 0.3 $\mu$m, (2) a light insensitive source of silver, and (3) a reducing agent for said light-insensitive source of silver.

2. An element according to claim 1 wherein the tabular grains account for greater than 90 percent of total grain projected area.

3. An element according to claim 1 wherein the tabular grains contain greater than 90 mole percent chloride, based on total silver.

4. An element according to claim 1 wherein the light-insensitive, reducible source of silver is a silver carboxylate.

5. An element according to claim 4 wherein the silver carboxylate is silver behenate.

6. An element according to claim 1 wherein the binder is a polymer of a vinyl acetal.

7. An element according to claim 1 wherein the light-insensitive, reducible source of silver is a silver salt of a mercapto or thione substituted compound.

8. An element according to claim 1 wherein the photothermographic layer contains a development accelerator.

9. An element comprised of a transparent film support and, coated on the film support, a photothermographic layer capable of providing a retained viewable silver image when imagewise exposed and heated, said layer being comprised of a photosensitive silver halide emulsion, silver behenate, a developing agent, and a binder comprised of a polymer of a vinyl butyral, wherein the photosensitive silver halide emulsion is comprised of silver halide grains including tabular grains having {100} major faces, containing greater than 90 percent chloride, based on silver, accounting for greater than 90 percent of total silver halide grain projected area, and exhibiting an average thickness of less than 0.2 $\mu$m.

* * * * *